US006863717B2

(12) United States Patent
Johnsen et al.

(10) Patent No.: US 6,863,717 B2
(45) Date of Patent: Mar. 8, 2005

(54) PLATE HANDLING SYSTEM AND A METHOD OF REMOVING PLATES FROM RAIL TIES

(75) Inventors: David Sean Johnsen, Wauwatosa, WI (US); William D. Straub, Milwaukee, WI (US); Bruce M. Boczkiewicz, Mukwonago, WI (US)

(73) Assignee: Nordco Inc., Oak Creek, WI (US)

( * ) Notice: Subject to any disclaimer, the term of this patent is extended or adjusted under 35 U.S.C. 154(b) by 0 days.

(21) Appl. No.: 10/113,585

(22) Filed: Mar. 29, 2002

(65) Prior Publication Data

US 2003/0183116 A1 Oct. 2, 2003

(51) Int. Cl.[7] ..... C09G 1/10
(52) U.S. Cl. ..... 106/6; 104/9
(58) Field of Search ..... 104/16, 17, 2, 104/5, 6, 9, 7.1, 17.1, 7.2; 293/4, 5; 428/63; 264/36

(56) References Cited

U.S. PATENT DOCUMENTS

| | | | | | |
|---|---|---|---|---|---|
| 2,730,962 | A | | 1/1956 | Wright et al. | 104/2 |
| 3,881,422 | A | * | 5/1975 | Bryan, Jr. | 104/9 |
| 3,943,858 | A | | 3/1976 | Dieringer et al. | 104/16 |
| 4,178,671 | A | | 12/1979 | Luttig | 29/429 |
| 4,241,663 | A | | 12/1980 | Lund et al. | 104/16 |
| 4,691,639 | A | | 9/1987 | Holley | 104/16 |
| 4,942,822 | A | | 7/1990 | Cotic | 104/16 |
| 4,974,518 | A | | 12/1990 | Cotic et al. | 104/16 |
| 5,063,856 | A | * | 11/1991 | Theurer et al. | 104/9 |
| 5,331,899 | A | * | 7/1994 | Holley | 104/16 |
| 5,617,795 | A | * | 4/1997 | Glomski et al. | 104/9 |
| 5,655,455 | A | * | 8/1997 | Smith | 104/16 |
| 5,722,325 | A | * | 3/1998 | Glomski et al. | 104/9 |
| 6,463,858 | B2 | * | 10/2002 | Weber et al. | 104/9 |

* cited by examiner

*Primary Examiner*—Frantz F. Jules
(74) *Attorney, Agent, or Firm*—Greer, Burns & Crain, Ltd.

(57) ABSTRACT

A rail plate handling device is provided for removing plates located on rail ties on a railroad track having a pair of rails, and includes a frame configured for movement relative to the track, at least one tie plate gripping assembly mounted to the frame, the assembly configured for grasping a selected tie plate, pulling the plate away from the rail and away from the tie, and subsequently releasing the plate onto the track. The device is mounted upon a cart which is movable on the track, and features gripping assemblies for working on both rails. A tie jack is preferably provided for ensuring the release of the tie from the gripped plate. Still another feature of the present device is a plate height mechanism associated with each gripping assembly for ensuring that the gripping assembly engages the plates at the proper height.

22 Claims, 6 Drawing Sheets

PLATE HANDLING SYSTEM AND A METHOD OF REMOVING PLATES FROM RAIL TIES

BACKGROUND OF THE INVENTION

This application relates generally to railway right-of-way maintenance equipment of the type used to repair and maintain railroad track. More specifically, the present invention relates to an apparatus for handling rail tie plates during replacement of rail ties.

Conventional railroad track consists of a plurality of spaced parallel wooden ties to which are attached a pair of spaced rail tie plates. Each tie plate is configured to rest on the upper surface of the tie and includes holes for receiving spikes or screws, as well as a canted seat or a cradle formation for receiving the bottom of the steel rail. Since two rails make up a railroad track, there are a pair of spaced tie plates on each tie. Some of the spikes are used to secure the tie plate on the tie and others are used to secure the base of the rail to the tie plate cradle.

During track maintenance operations, it is common to periodically remove worn out or rotten ties. This is accomplished by first removing the spikes which hold the plates to the tie as well as to the rail. Next, a machine, such as disclosed in commonly-assigned U.S. patent application Ser. No. 09/810,975, filed Mar. 16, 2001, which is incorporated by reference, lifts the rail and extracts the worn tie from underneath. As the tie is extracted, the loosened tie plates either fall into the rail bed or ballast, or are retained on the removed tie. Conventional practice is manually remove the plates and throw them off to the side of the ballast so that they do not interfere with the replacement of the new tie. Once the new tie is inserted under the raised track, the plates must be reinserted in the appropriate position to support the rail and for re-spiking.

To avoid on the job injuries, especially those involved with handling tie plates, which typically weigh approximately 18–40 pounds and are heavy to manipulate, railways have attempted to mechanize the tie replacement and plate placement process as much as possible. One attempt has been to provide a mechanism which grips the plates and secures them to the rail as the tie is removed from beneath the plates. This system has not been widely accepted by the railroads because of its relatively complicated mechanism, and because in many instances the insertion of the new tie will cause particles of railway ballast to be retained on top of the tie and interfere with the repositioning of the tie plates. These conventional mechanisms have no way to remove unwanted ballast particles from the top surface of the tie.

Another drawback of conventional mechanized plate placement devices is that their speed is relatively slow and they cannot keep up with the other operations of the rail maintenance gang. Using manual removal and placement of tie plates, the tie replacement process typically operates at a rate of about 15 ties per minute. Conventional mechanized plate removal devices operate in the range of 3 to 5 ties per minute. At this point, this rate of production is unacceptable to the railroads.

Accordingly, a first object of the present invention is to provide an improved plate handling system which reduces the manual handling of plates during the tie replacement process.

Another object of the present invention is to provide an improved plate handling apparatus in which the rail tie plates are securely held by the apparatus during the tie replacement procedure.

SUMMARY OF THE INVENTION

The above-identified objects are met or exceeded by the present plate handling system which features a mechanism for grasping the tie plates once the spikes have been removed and the rail lifted. The grasped plates are then moved away from the vicinity of the tie while the tie is removed and a new tie inserted. In one embodiment, the mechanism drops the plates on the ballast out of the way of the tie. In a preferred embodiment, the mechanism is provided on a mobile cart which moves independently of other rail maintenance equipment, such as but not restricted to a tie extracting machine.

More specifically, the present invention provides a rail plate handling system for removing plates located on rail ties on a railroad track having a pair of rails. The system includes a frame configured for movement relative to the track, at least one tie plate gripping assembly mounted to the frame, the assembly configured for grasping a selected tie plate, pulling the plate away from the rail and away from the tie, and subsequently releasing the plate onto the track.

In a preferred embodiment, the system is mounted upon a cart which is movable on the track relative to other rail maintenance equipment, and features gripping assemblies for working on both rails. It is also preferred that at least one of such gripping assemblies be provided with a tie jack for ensuring the release of the tie from the gripped plate. Still another feature of the present system is a plate height mechanism associated with each gripping assembly for ensuring that the gripping assembly engages the plates at the proper height.

DETAILED DESCRIPTION OF THE INVENTION

Figure 1:
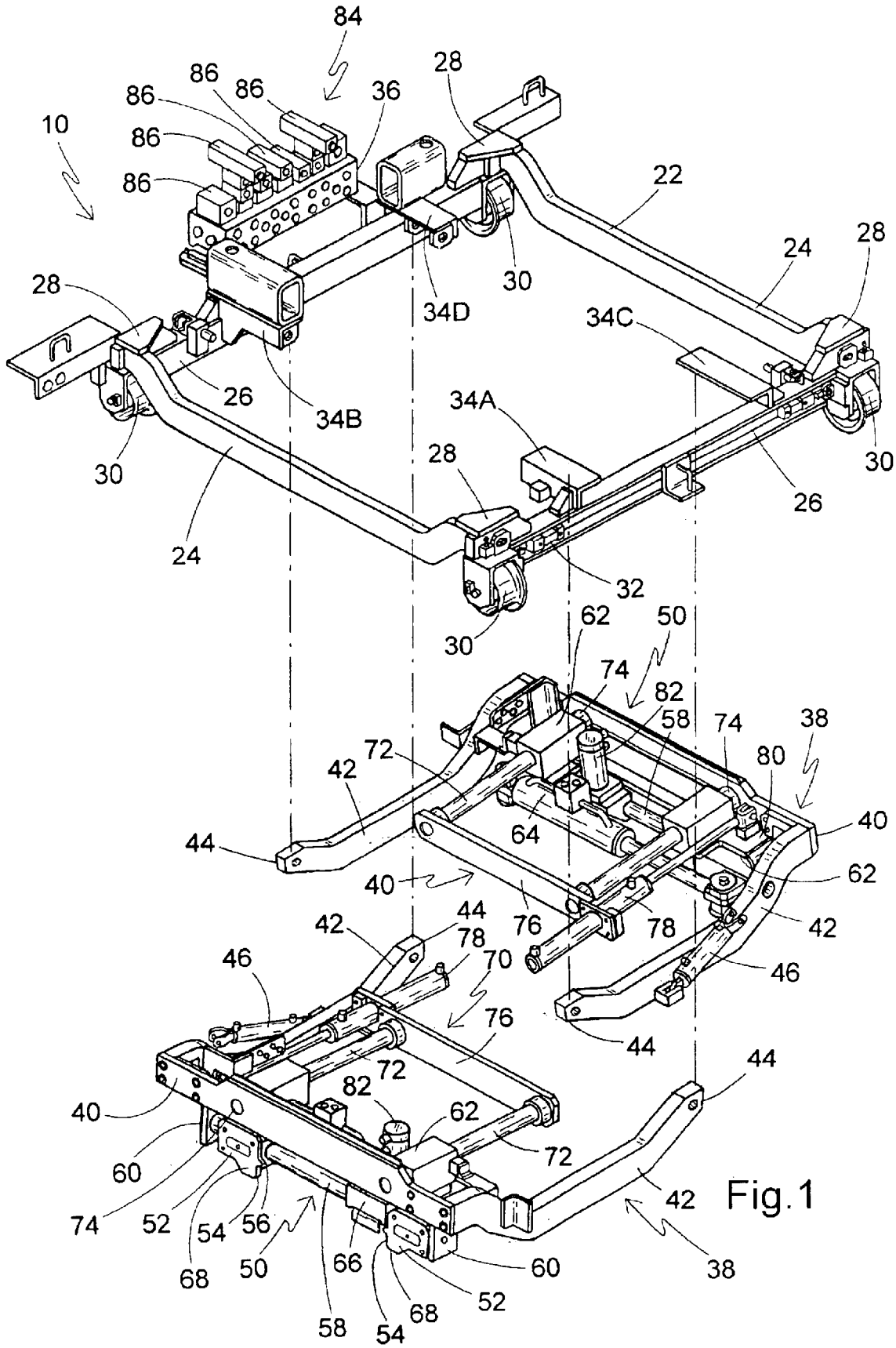
FIG. 1 is an exploded perspective view of the device of the present rail tie plate handling system.
Figure 2:
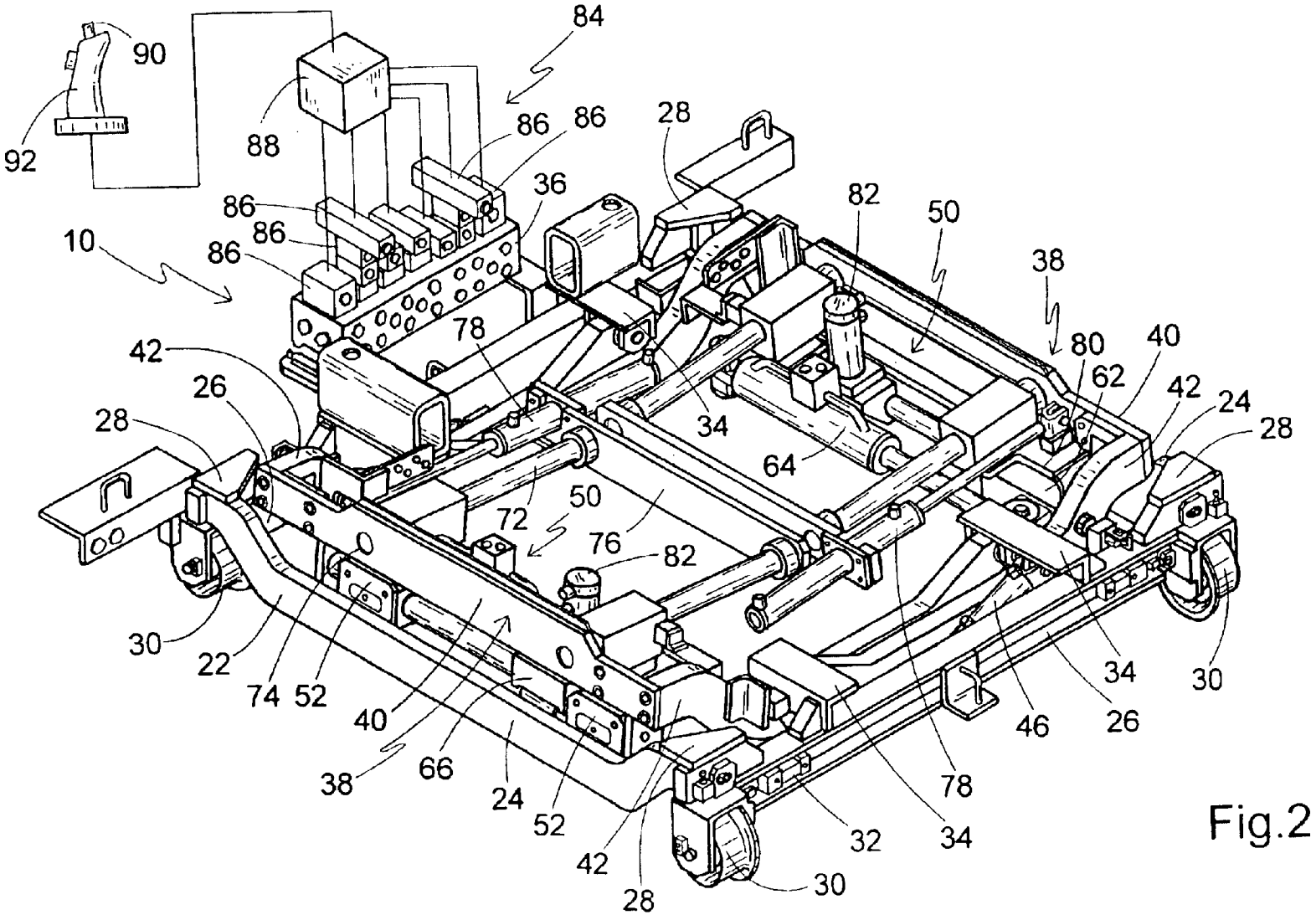
FIG. 2 is a perspective elevation of a rail maintenance device incorporating the present rail tie plate handling system, shown in the rest or travel position.
Figure 4:
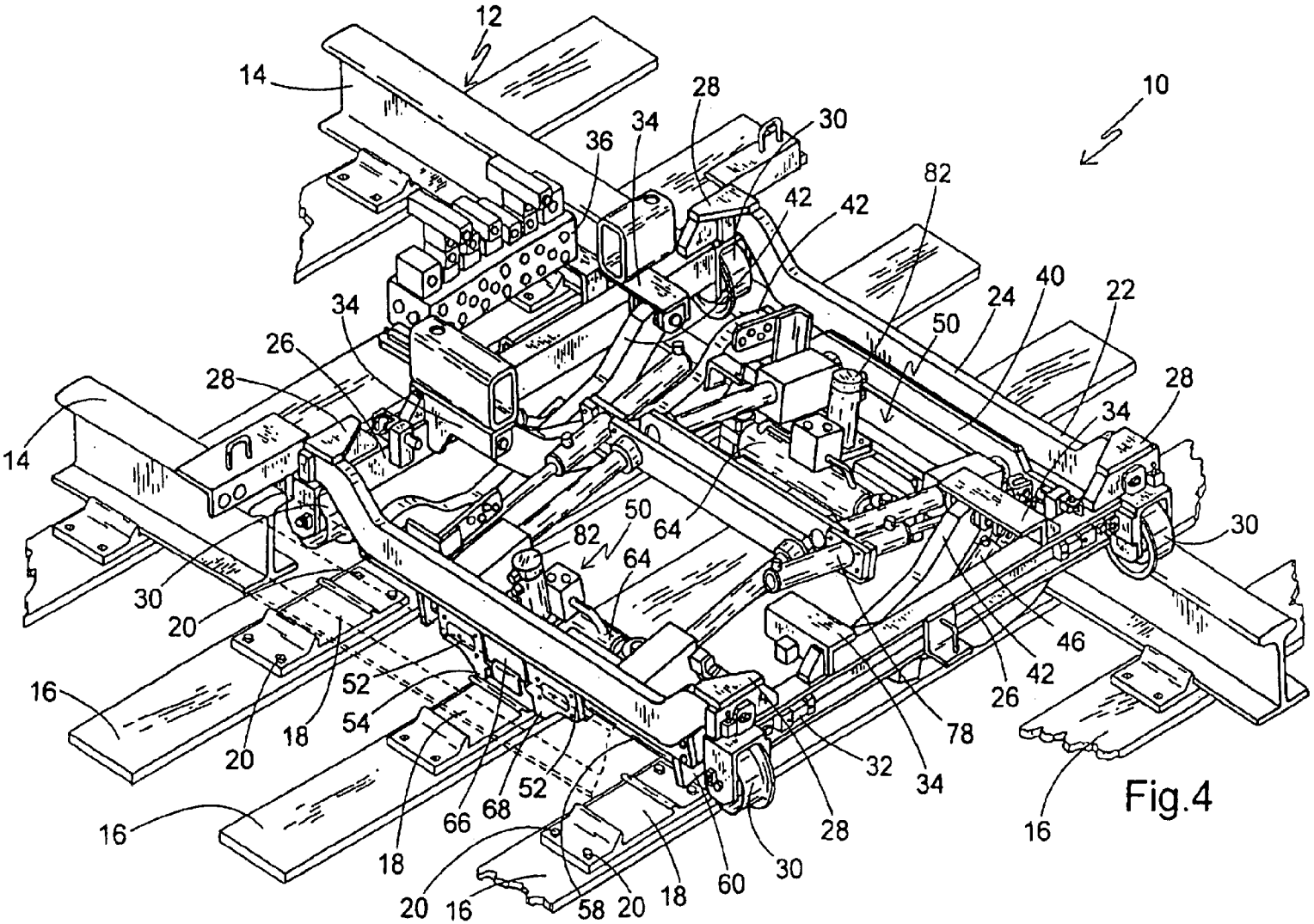
FIG. 4 is a perspective elevation of the device of FIG. 2 shown in the tie plate grasping position.

Referring now to FIGS. 1, 2 and 4, a railroad maintenance rail tie plate handling system features a device generally designated 10, and is specifically designed for use in removing tie plates from railroad track 12, which is made up of a pair of spaced rails 14, which are secured to a plurality of spaced, parallel ties 16 by a plurality of tie plates 18. As is well known, the ties 16 are typically wood, but are also made of concrete in some applications. The present application is concerned with track laid upon wooden ties 16, which periodically need replacement due to natural deterioration. As is known in the art, the tie plates 18 are secured to the ties 16 by spikes 20 or threaded fasteners. Only a few spikes 20 are depicted in FIG. 4, since at that stage of the rail maintenance operation, all of the spikes would be withdrawn from tie plates about to be removed. The present device and/or system is preferably designed for use in conjunction with a rail tie extraction apparatus of the type disclosed in commonly assigned U.S. Pat. Ser. No. 09/810,975, filed Mar. 16, 2001, which is incorporated by reference herein. However, it is contemplated that the device 10 may alternately be provided as a self-propelled unit independently movable along the track 12, having an operator's control station and a power source as is known in the art.

The present device 10 includes a main frame 22 configured for movement relative to the track 12 and provided with a pair of generally parallel side members 24 and a pair of end members 26, which are connected at respective comers 28 to form a square or rectangular frame shape. Flanged rail wheels 30 are rotatably mounted at each comer 28. In the preferred embodiment, each wheel 30 is provided with a centering mechanism on each side of the frame for centering the main frame 22 relative to the track 12. In the preferred embodiment, the adjustment mechanism includes a centering cylinder 32 mounted to the frame 22 and configured for positioning the corresponding wheel relative to the frame 22. The cylinder 32 is a fluid power cylinder (hydraulic or pneumatic), but hydraulic types are preferred, as is the case with all of the fluid power cylinders in the device 10 described below. A feature of the invention is that, by adjusting the relative pressure to, and extension of, the cylinders 32, the frame 22 is maintained in a centered position upon the track 12.

Also found on the frame 22 is at least one and preferably four anchor points 34 preferably located on the end members 26. The anchor points 34 are provided in pairs, with one associated anchor point on each corresponding end member 26, i.e., points 34*a* and 34*b* are associated with each other, as are anchor points 34*c* and 34*d* (FIG. 1). A hydraulic control module and manifold 36 is also secured to the frame 22 for controlling the fluid flow to the various fluid power cylinders described below.

Attached to the frame 22 are at least one and preferably two generally "U"-shaped subframes 38, each being provided with a base member 40 to which are attached a pair of arms 42. Each arm 42 has a free end 44 (best seen in FIG. 1) which is pivotally secured to a corresponding one of the anchor points 34. In the preferred embodiment, the anchor points 34 are clevis mounts with the free ends 44 located between the clevis blades, however it is contemplated that a reversed orientation could also be suitable, provided secure pivoting action is achieved. In the preferred embodiment, two subframes 38 are secured to the frame 22 so that each of the bases 40 is associated with a corresponding side member 24. However, it is contemplated that the number and orientation of the subframes 38 may vary to suit the application.

The pivoting action of each of the subframes 38 relative to the frame 22 is controlled by a corresponding subframe control cylinder 46 (best seen in FIG. 1) which is connected at one end to the subframe and at the other end to the frame 22 near the anchor point 34. Preferably using a clevis mount, although other pivotal cylinder mounts are contemplated, the subframe control cylinders 46 are secured to the anchor point 34 so that extension and retraction of the cylinder will cause the subframe to pivot down and up respectively, relative to the frame 22. A raised or rest position in which the control cylinders 46 are retracted is depicted in FIG. 2, and a lowered or plate-engaging position in which the control cylinders are extended is depicted in FIGS. 3–6.

Also included in the device 10, and mounted on at least one of the subframes 38 and ultirnatelyto the frame 22, is at least one tie plate gripping assembly 50 configured for grasping a selected tie plate 18, pulling the plate away from an adjacent one of the spaced rails 14 and away from the tie 16, and subsequently releasing the plate. While, in the preferred embodiment, the device 10 in general, and the subframes 38 and the gripping assembly 50 specifically, are configured to move the grasped tie plate 18 inwardly away from the adjacent rail 14 and upwardly on an incline away from the tie 16, it is contemplated that other directions of separation of the plate from the track are contemplated, including outwardly away form the rail and/or horizontally away form the tie. More specifically, each gripping assembly 50, of which there are preferably two on the device 10, is associated with a corresponding side member 24. While two assemblies 50 and subframes 38 are preferably provided in the device 10, for simplicity, the construction and operation of only one of the subframes 38 will be described here. It will be understood that both subframes 38 and their associated components operate in the same manner.

Included on each gripping assembly 50 is at least a pair of opposing jaws 52 which include a plate-engaging blade 54 and a throughbore 56 for slidably engaging a jaw guide bar 58 (all best seen in FIG. 1). The jaws 52 reciprocate under operator control on the assembly 50 in a direction parallel to the corresponding rail 14. The jaw guide bar 58 is fastened at each end to a flange 60 on a guide block 62, two of which are provided to each gripping assembly 50. Movement of each of the jaws 52 is controlled by a gripping cylinder 64, each end of which is connected to a clevis or equivalent mount on a corresponding one of the jaws 52. Thus, retraction of the gripping cylinder 64 will bring the jaws 52 together, and extension of the gripping cylinder will separate the jaws.

A rail plate-contacting guide 66 is preferably freely slidably engaged on the jaw guide bar 58 between the two jaws 52. As the gripping cylinder 64 retracts and the jaws 52 grip corresponding front and rear edges of the tie plate 18 (best seen in FIG. 5), the plate contacting guide 66 will engage an upper surface of the plate being gripped and ensure that the blades 54 are in proper contact with the plate. As the guide 66 contacts the upper surface of the tie plate 18, the subframe 38 will move up or down respectively to maintain the proper engagement. The blades 54 are configured with a depending lobe 68 for digging into the tie 16 when necessary to positively engage plates 18 which become embedded into the wood over time.

Figure 3:
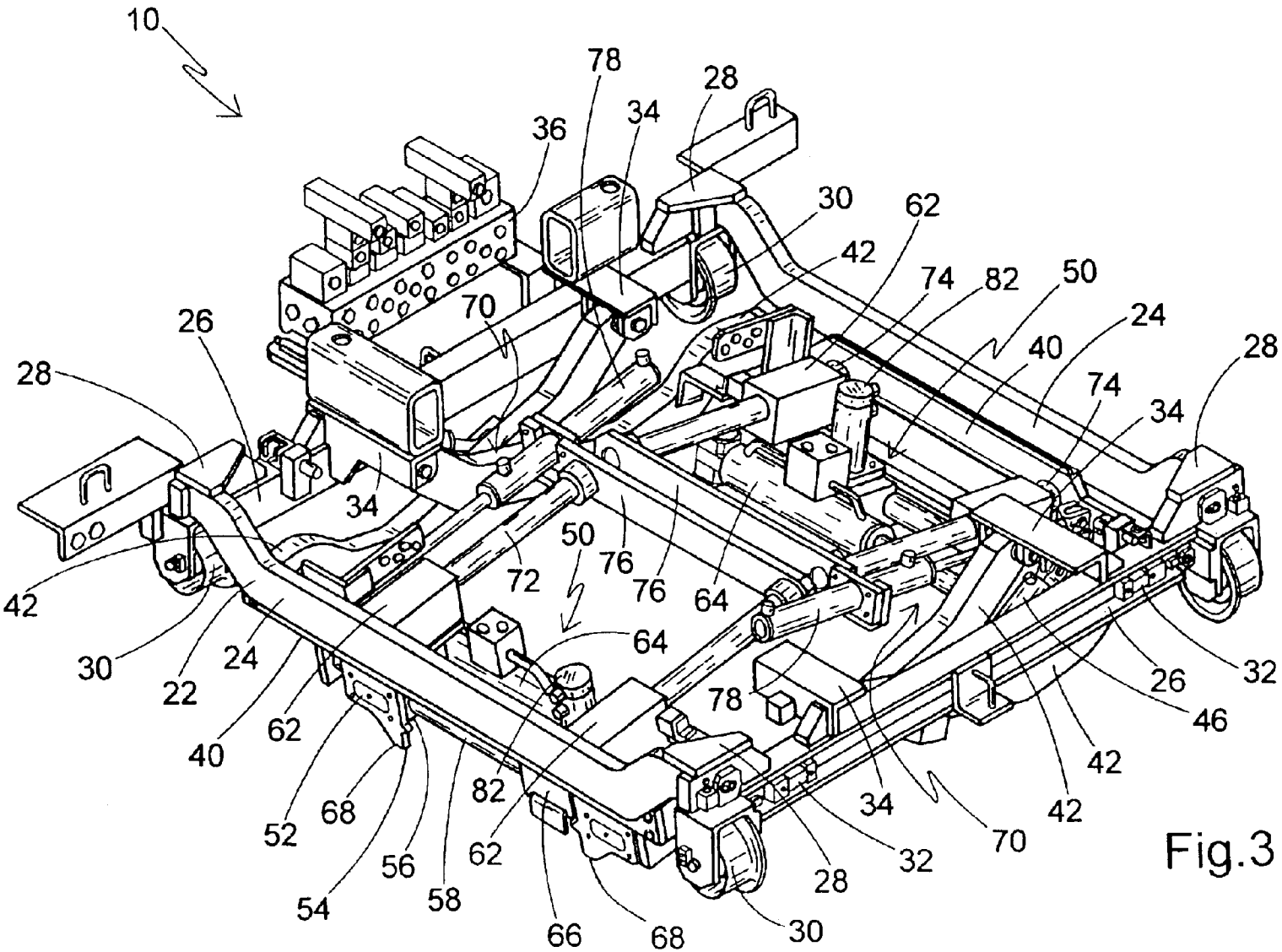
FIG. 3 is a perspective elevation of the device of FIG. 2 shown in the tie plate selection position.

Referring now to FIGS. 1 and 3, each of the gripping assemblies 50 also includes a retracting mechanism 70 for moving the gripping assembly upward and away from the tie 16 along an inclined path defined by the pivoted subframe 38, which has pivoted downward toward the track 12 through the extension of the subframe control cylinder 46. As described above, alternate directions of tie plate displacement are contemplated. The retracting mechanism 70 includes a pair of guide rods 72 which are secured at one end in bores 74 in the base 40, on the way slidably passing through the guide blocks 62, and at an opposite end to a stabilizer bar 76. At least one fluid power-retracting cylinder 78 is connected to the stabilizer bar 76 at one end, and at the opposite end to a flange 80 (best seen in FIG. 1) extending from the guide block 62.

A tie jack 82 is preferably provided to the gripping assembly 50 for facilitating the removal of the tie plate 18 from the tie 16. Very often, upon the gripping of the tie plate 18 by the jaws 52, the tie 16 does not immediately become detached from the plate. To facilitate this detachment, the tie jack 82 includes a piston shaft (not shown), which depends generally vertically under fluid power to press against the tie 16 and disengage it from the tie plate 18. The tie jack 82 is preferably laterally offset from the gripping jaws 52 so that, upon the gripping engagement of the tie plate 18 by the jaws, the tie jack shaft will contact the tie 16.

Referring now to FIGS. 1 and 2, the present device 10 includes a control mechanism 84 for controlling the plate gripping and moving operations. Included in the control mechanism 84 is the hydraulic manifold 36 which receives the fluid power (preferably hydraulic) lines which are connected to the various cylinders 32, 46, 64, 78 and 82. The manifold 36 is also connected to a plurality of hydraulic control valves 86 which, with the hydraulic lines and the cylinders 32, 46, 64, 78 and 82 form a hydraulic circuit as is well known in the art. The valves 86 are preferably automatically operated by a control circuit (schematically indicated at 88) of the type known in the art, and are preferably triggered by an operator actuating a button or switch 90 on an operator-manipulated control device 92, preferably a joystick, however other equivalent control units are contemplated. By manipulating the button or switch 90, the operator controls the tie plate gripping operation, including the sequential lowering of the subframe 38 with its associated gripping assembly 50, the movement of the gripping jaws 52 to grasp a selected tie plate 18, the inward movement of the gripping assembly 50 away from the rail and upwardly away from the tie, and the release of the gripping jaws to permit the gripped plate 18 to fall to the track. It will be appreciated that once the plate gripping cycle is initiated, some of the hydraulically controlled tasks are performed automatically, as is well known in the art.

In operation, and referring now to FIGS. 2 and 4, the present device 10 moves along the track 12 until the operator locates a tie 16 needing replacement. The various plate gripping and moving components are in their at rest or inactive positions. Using the joystick 92, the device 10 is positioned relative to the tie 16 in question so that the tie is between the gripping jaws 52. However, the specific position of the device 10 relative to the subject tie 16 may vary with each gripping cycle. In conjunction with the positioning of the device 10, preferably both of the rails 14 are raised by another device, such as that described in U.S. patent application Ser. No. 09/810,975, a sufficient height to permit extraction of the selected tie and associated tie plate (FIG. 4). Once the device 10 is in position, the operator actuates the switch or button 90 to initiate the automatic sequence described below.

Referring now to FIG. 3, the subframe control cylinder 46 is extended so that the subframe 38 pivots about the anchor points 34. In this position, the base 40 is in close proximity to the corresponding rail 14, and the subframe arms 42 are inclined upward from the frame side member 24 to the middle of the main frame 22. The gripping assembly 50 is positioned adjacent the base 40 of the subframe 38.

Referring now to FIG. 4, next, the gripping cylinder 64 is retracted, bringing the gripping jaws 52 together about a tie plate 18. Since the device 10 may not always encounter the tie plate 18 at the same position, the gripping jaws 52 are configured so that whichever jaw 52 is closer to the tie plate 18 engages the plate first, and the other jaw 52 has to travel the farther distance to grip the opposite edge of the tie plate. To maintain the gripping jaws 52 at the proper height, the plate contacting guide 66 contacts an upper surface of the tie plate as the gripping jaws 52 come together about the plate. The contacting guide causes the subframe 38 to be raised or lowered if necessary to optimize the gripping action of the jaws 52.

Once the plate 18 has been securely gripped as described above, at this time, if the tie plate 18 has not become totally detached from the tie 16, the tie jack 82 is engaged, which impacts the tie and ensures its separation from the plate.

Figure 5:
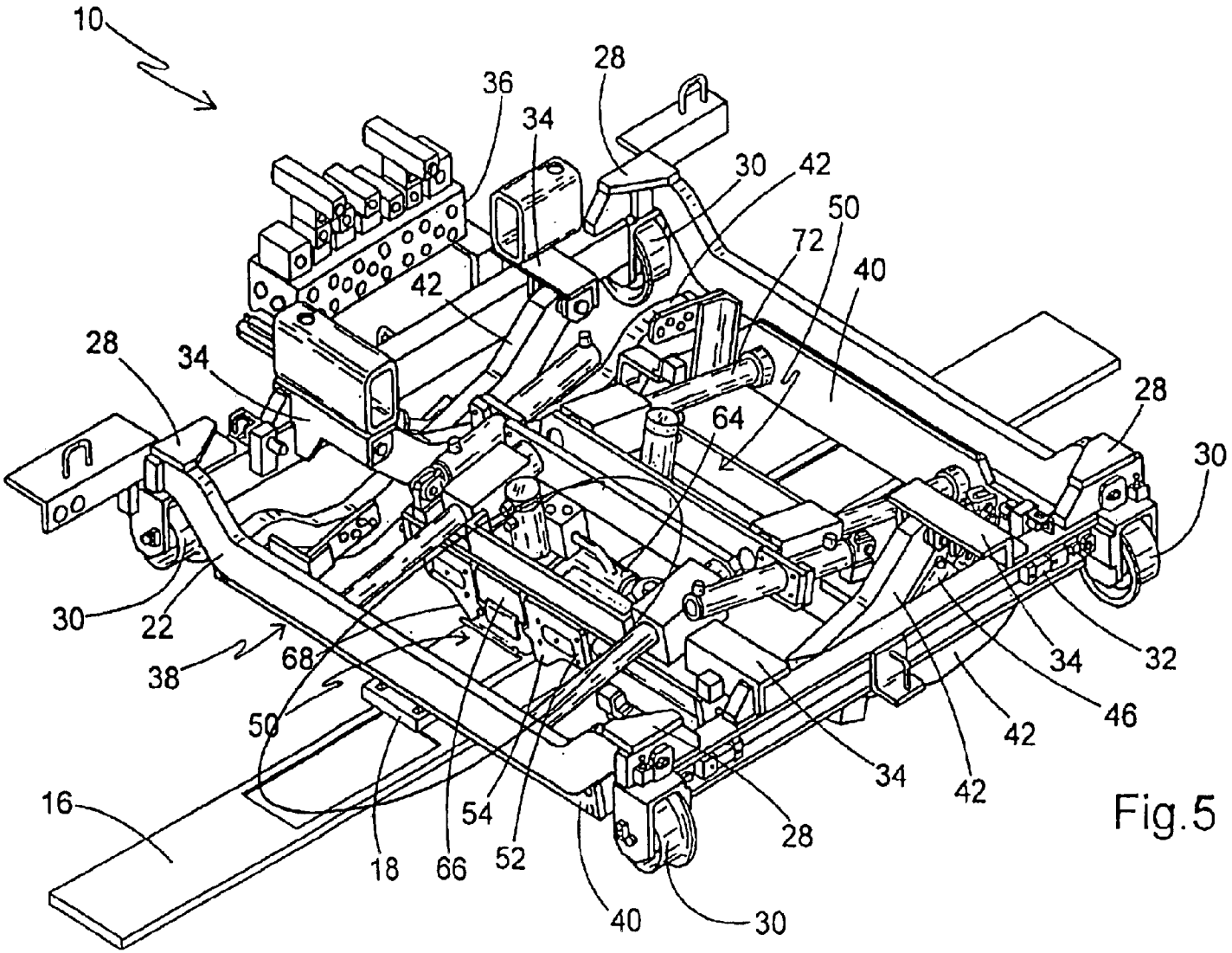
FIG. 5 is a perspective elevation of the device of FIG. 2 shown in the tie plate retracting position.

Referring now to FIG. 5, once the plate 18 has been securely gripped at its forward (or front) and rear edges by the gripping jaws 52, the automatic control circuit 88 is configured to cause the retracting cylinders 78 to retract, pulling the gripping assembly Soup the incline of the subframe 38, and toward the middle of the device 10. The guide rods 72 have sufficient length to pull the tie plate 18 toward the middle of the device 10 so that it is away from the rail 14.

Figure 6:
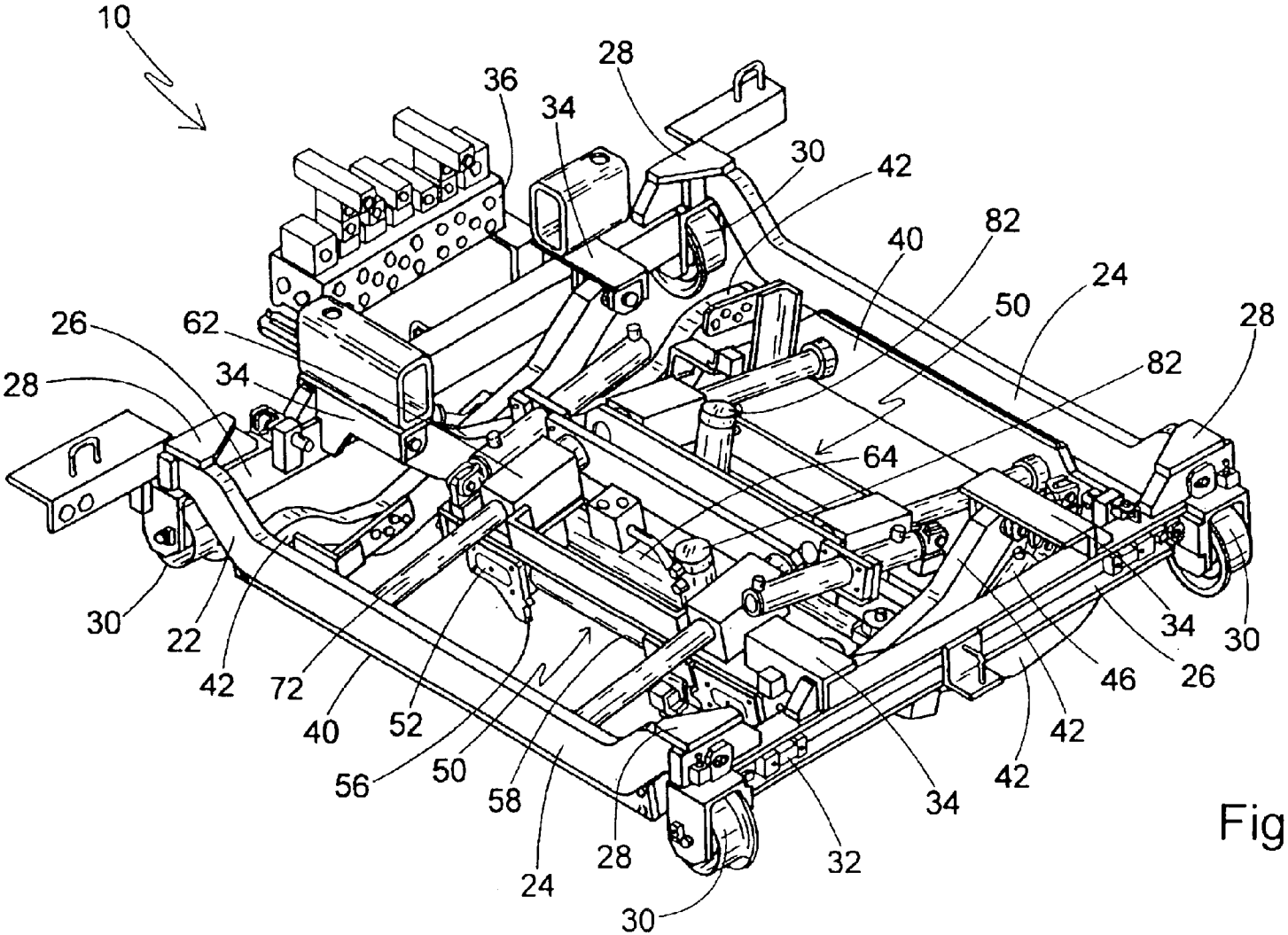
FIG. 6 is a perspective elevation of the device of FIG. 2 shown in the tie plate release position.
Figure 5:
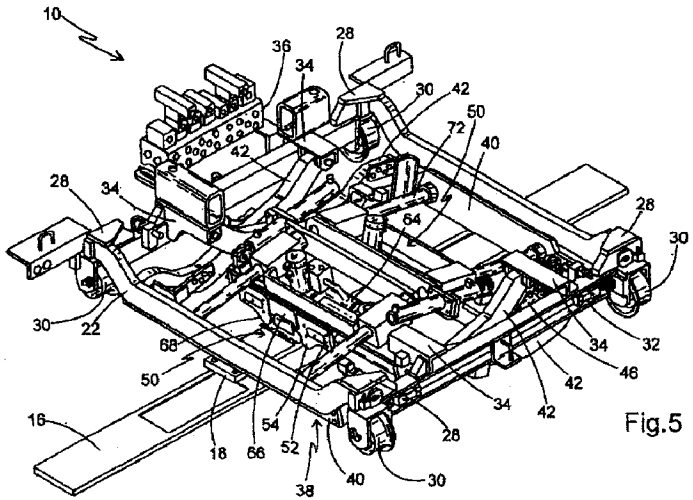

Referring now to FIG. 6, once the retracting cylinders 78 are fully retracted, the gripping assembly 50 is in its centermost and uppermost position in the operational cycle. At this point, the tie 16 is removed by being gripped by a separate tie extraction apparatus, preferably of the type disclosed in commonly assigned U.S. Pat. Ser. No. 09/810,975, filed Mar. 16, 2001. In some cases, at this point, a new tie will be inserted to replace the old one just extracted. Once the tie 16 has been extracted, the gripping jaws 52 are separated by pressurizing and extending the gripping cylinder 64, releasing the tie plate 18 to fall upon the track 12 between the rails 14. Upon release of the plate 18, the retracting cylinder 78 extends to move the gripping assembly back to its rest position (FIG. 2), and the subframe control cylinder 46 retracts and raises the base 40 of the subframe 38 to its rest position (FIG. 2). The raised rails 14 are then lowered. The device 10 is now ready to move to the next tie 16 slated for replacement. While the removal of only one tie plate 18 at a time has been described, it will be appreciated that both subframes 38 and gripping assemblies 50 may be simultaneously operational, to remove the two tie plates 18 located on a single tie.

It will be appreciated that the present rail plate handling system 10 features the ability to securely grip plates to be removed and to separate them from ties slated for replacement. The rate of plate gripping and removal accomplished by the present device 10, that is, in the range of 3–5 ties per minute, is over all more efficient than using manual labor for plate removal, in that the issues of worker fatigue and manpower costs are eliminated. Also, the above-described drawbacks of conventional automatic plate removal devices have been overcome.

While a particular embodiment of the present rail tie plate handling system has been disclosed herein, it will be appreciated by those skilled in the art that changes and modifications may be made thereto without departing from the invention in its broader aspects and as set forth in the following claims.

What is claimed is:

1. A rail plate handling device for removing tie plates located on rail ties on a railroad track having a pair of rails, each tie plate supporting one of the rails on an associated tie and having front and rear edges corresponding to the direction of travel along the railroad track, wherein at least one of said rails is raised from an operational position, said device comprising:

a frame configured for movement relative to the track;

at least one tie plate gripping assembly mounted to said frame and configured for grasping a selected one of the tie plates at the front and rear edges between an adjacent one of the at least one raised rail raised from the operational position supported by the selected tie plate and the associated tie in the operational position upon which the plate was resting, pulling the selected plate away from the adjacent raised rail and away from the associated tie, and subsequently releasing the plate.

2. The device of claim 1 wherein said frame is provided with a pair of said gripping assemblies, one said assembly associated with a corresponding side of said frame.

3. The device of claim 2 wherein at least one of said gripping assemblies includes a pair of opposing jaws which are configured for controlled reciprocation in a direction parallel to the rails.

4. The device of claim 1 wherein said at least one gripping assembly is configured for pulling the plate inwardly away from the adjacent rail.

5. The device of claim 1 wherein said at least one gripping assembly is configured for pulling the plate upwardly away from the tie upon which said plate was resting and supporting the adjacent rail.

6. The device of claim 1 wherein said at least one gripping assembly is pivotally secured to the frame to move between a raised and a lowered position relative to said frame.

7. The device of claim 6 wherein each said gripping assembly is secured to a subframe which is pivotable relative to said frame to provide for moving said gripping assembly between said raised position and said lowered position.

8. The device of claim 7 wherein said at least one gripping assembly is configured so that when in the lowered position, said jaws are placed in operational proximity of a respective tie plate, and an inclined path is defined by said assembly for moving the gripped plate away from the rail and on said inclined pathaway from the tie.

9. The device of claim 8 further including a retracting mechanism for moving said plate gripping assembly upward and away from said tie along said inclined path.

10. The device of claim 9 wherein said retracting mechanism includes at least one fluid power cylinder and a pair of guide rods secured at one end to said subframe.

11. The device of claim 8 further including a tie jack provided to said gripping assembly and movable with said jaws on said path for facilitating the removal of the tie plate from the tie.

12. The device of claim 6 wherein said at least one said gripping assembly includes at least a pair of reciprocating plate gripping jaws.

13. The device of claim 12 further including a rail plate contacting guide slidably engaged between said jaws for contacting an upper surface of the tie plate and adjusting the height of said subframe so that said gripping jaws are properly positioned.

14. The device of claim 1 further including a tie jack provided to said gripping assembly for facilitating the removal of the tie plate from the tie.

15. The device of claim 1 further including a control mechanism for sequentially triggering and controlling the lowering of said at least one tie plate gripping assembly mounted to the frame to the operational vicinity of the selected tie plate, the grasping of the selected tie plate, the pulling the plate inwardly away from the rail and upwardly away from the tie, and the subsequent releasing the plate onto the track.

16. The device of claim 1, further including a centering mechanism on at least one side of said frame for centering said frame relative to the track.

17. A rail plate handling device for removing tie plates located on rail ties on a railroad track having a pair of rails, each tie plate supporting one of the rails on an associated tie, said device comprising:

a frame configured for movement relative to the track;

at least one subframe pivotally engaged on said frame for movement between a raised and a lowered position;

at least one tie plate gripping assembly mounted each said subframe, said subframe including a pair of opposed gripping jaws configured for grasping a selected one of the plates; and a rail tie plate contacting guide being slidably positioned between said gripping jaws and being configured for contacting an upper surface of the selected rail tie plate and causing said subframe to pivot to ensure positive engagement of the plate by said gripping jaws.

18. The device of claim 17 wherein said gripping jaws are reciprocally slidable on a jaw guide bar, and said rail tie plate contacting guide is at least one block slidably engaged on said guide bar between said jaws.

19. A method for removing tie plates from railroad ties on a railroad track including a pair of rails, each tie plate supporting one of the rails on an associated tie in an operational position and having front and rear edges corresponding to the direction of travel along the railroad track, wherein at least one of said rails is raised from the operational position, said method comprising:

grasping front and rear edges of a selected one of the tie plates at the front and rear edges between the associated tie and a respective one of the raised rails raised from the operational position;

retracting the grasped tie plate in a direction away from the respective raised rail;

simultaneously raising the grasped tie plate to separate it from the corresponding tie; and releasing the grasped tie plate to allow it to fall upon the track.

20. The method of claim 19 further including:

providing a pivoting subframe with opposing gripping jaws;

lowering said subframe in position relative to the rail so that said jaws each engage a corresponding front or rear edge of the tie plate;

providing a guide member to slide relative to the opposed jaws; and causing the jaws to move towards each other with the plate in between so that said guide member engages an upper surface of the tie plate and pivotally adjusts the height of the subframe so that said gripping jaws positively engage the plate.

21. A rail plate handling device for removing tie plates located on rail ties on a railroad track having a pair of rails, each tie plate supporting one of the rails on an associated tie, said device comprising:

a frame configured for movement relative to the track;

at least one tie plate gripping assembly mounted to said frame, said assembly configured for grasping a selected one of the plates, pulling the plate away from a respective one of the rails and away from the associated tie, and subsequently releasing the plate; and a tie jack provided to said gripping assembly for facilitating the removal of the tie plate from the tie.

22. A rail plate handling device for removing tie plates located on rail ties on a railroad track having a pair of rails, each tie plate supporting one of the rails on an associated tie and having front and rear edges corresponding to the direction of travel along the railroad track, at least one of said rails being raised from an operational position, said device comprising:

a frame configured for movement relative to the track;

at least one tie plate gripping assembly mounted to said frame, said assembly configured for grasping a selected one of the tie plates at the front and rear edges between an adjacent one of the raised rails and the associated tie upon which the plate was resting, pulling the plate transversely away from the adjacent raised rail and away from the associated tie by movement of said assembly up an incline, and subsequently releasing the plate.

* * * * *

UNITED STATES PATENT AND TRADEMARK OFFICE

CERTIFICATE OF CORRECTION

PATENT NO. : 6,863,717 B2
APPLICATION NO. : 10/113585
DATED : March 8, 2005
INVENTOR(S) : Johnsen et al.

It is certified that error appears in the above-identified patent and that said Letters Patent is hereby corrected as shown below:

In the Drawings:

Delete Fig. 5 and replace with corrected Fig. 5 (as correctly indicated in Amendment A filed May 19, 2003).

Col. 4, Line 14, Delete "ultirnatelyto" and insert --ultimately to-- (as correctly indicated in the Specification, page 7, line 19, filed March 29, 2002).

Col. 6, Line 36, Delete "Soup" and insert --50 up-- (as correctly indicated in the Specification, page 12, line 12, filed March 29, 2002).

Signed and Sealed this
Twentieth Day of December, 2011

David J. Kappos

David J. Kappos
*Director of the United States Patent and Trademark Office*